United States Patent [19]

Lentz

[11] 4,030,627

[45] June 21, 1977

[54] TV BULB FUNNEL CONSTRUCTION

[76] Inventor: William P. Lentz, Addison, N.Y.

[22] Filed: May 10, 1976

[21] Appl. No.: 684,628

[52] U.S. Cl. ..... 220/2.1 A

[51] Int. Cl.[2] ..... H01J 5/20; H01J 29/00

[58] Field of Search ..... 220/2.1 A, 2.3 A; 313/402–408, 477, 482

[56] References Cited

UNITED STATES PATENTS

| | | | |
|---|---|---|---|
| 2,236,708 | 4/1941 | Grimditch | 220/2.1 A |
| 2,697,311 | 12/1954 | Polan | 220/2.1 A X |
| 2,837,235 | 6/1958 | Vincent | 220/2.3 A |
| 2,966,997 | 1/1961 | Stutske | 313/477 X |
| 3,071,280 | 1/1963 | Mayhew et al. | 220/2.1 A |
| 3,404,302 | 10/1968 | Nicklas | 220/2.1 A X |
| 3,971,490 | 7/1976 | Conger | 220/2.1 A |

FOREIGN PATENTS OR APPLICATIONS

| | | | |
|---|---|---|---|
| 1,026,624 | 4/1966 | United Kingdom | 220/2.1 A |

*Primary Examiner*—Stephen Marcus

*Attorney, Agent, or Firm*—Burton R. Turner; Clarence R. Patty, Jr.

[57] ABSTRACT

TV bulbs are composed of funnels and panels, and the present invention sets forth a novel construction of a funnel for a TV bulb which not only incorporates thinner walls than a conventional funnel, but which also utilizes less total glass when formed into a bulb than a conventional TV bulb, while retaining the required strength and sealing surface area necessary to form an evacuated TV tube when sealed to a viewing panel.

8 Claims, 4 Drawing Figures

TV BULB FUNNEL CONSTRUCTION

BACKGROUND OF THE INVENTION

Conventional TV bulbs include a panel member having a viewing portion with a depending skirt portion about the periphery thereof, and a funnel member having a narrow neck portion communicating with a yoke portion which expands outwardly into an open wide mouth portion. The skirt portion of the panel member and the wide mouth portion of the funnel member are provided with mating sealing surfaces which are ultimately sealed together in forming a TV bulb. In order to impart necessary strength to the bulb when evacuated to form a TV tube, both the walls of the skirt portion and the walls of the funnel member between the yoke portion and wide mouth portion are relatively heavy to not only provide such necessary strength and rigidity to the evacuated tube, but also to provide adequate seal area between the panel and the funnel.

When pressing glass articles, such as TV funnels, the amount of glass required is directly proportional to the thickness of the walls employed. Further, production rates are inversely proportional to the thickness of the pressed article in view of the fact that sufficient heat must be removed from each newly pressed article so that such article retains its structural rigidity when removed from the mold. Accordingly, the thicker the wall portions of the article pressed, the greater the amount of time required in order to extract the necessary amount of heat from the article so that it will become rigid and not detrimentally deform upon removal from the mold.

SUMMARY OF THE INVENTION

In its simplest form, the present invention sets forth a novel funnel construction for a TV bulb wherein the side wall portions of the funnel are of a thinner wall construction than conventional TV funnels and accordingly not only utilize less total glass per bulb resulting in a saving in batch raw materials and energy required to melt the batch, but also facilitates substantially higher production rates since cooling times required for removing the article from the pressing mold are substantially reduced. Further, whereas the stresses which were concentrated at the seal area of the conventional TV bulb were compensated for through the utilization of a rigid heavy walled funnel construction, the funnel of the present invention incorporates the utilization of relatively thin walls which distribute and dissipate the stresses generated at the seal area.

It thus has been an object of the present invention to provide an improved funnel construction for a TV bulb which not only has thinner walls than a conventional TV funnel, but which also may be produced at higher production rates than such funnels while retaining the requisite strength and seal area to withstand the stresses generated when the funnel is sealed to a panel and the resulting bulb evacuated to form a TV tube.

DESCRIPTION OF THE PREFERRED EMBODIMENTS

Figure 1:
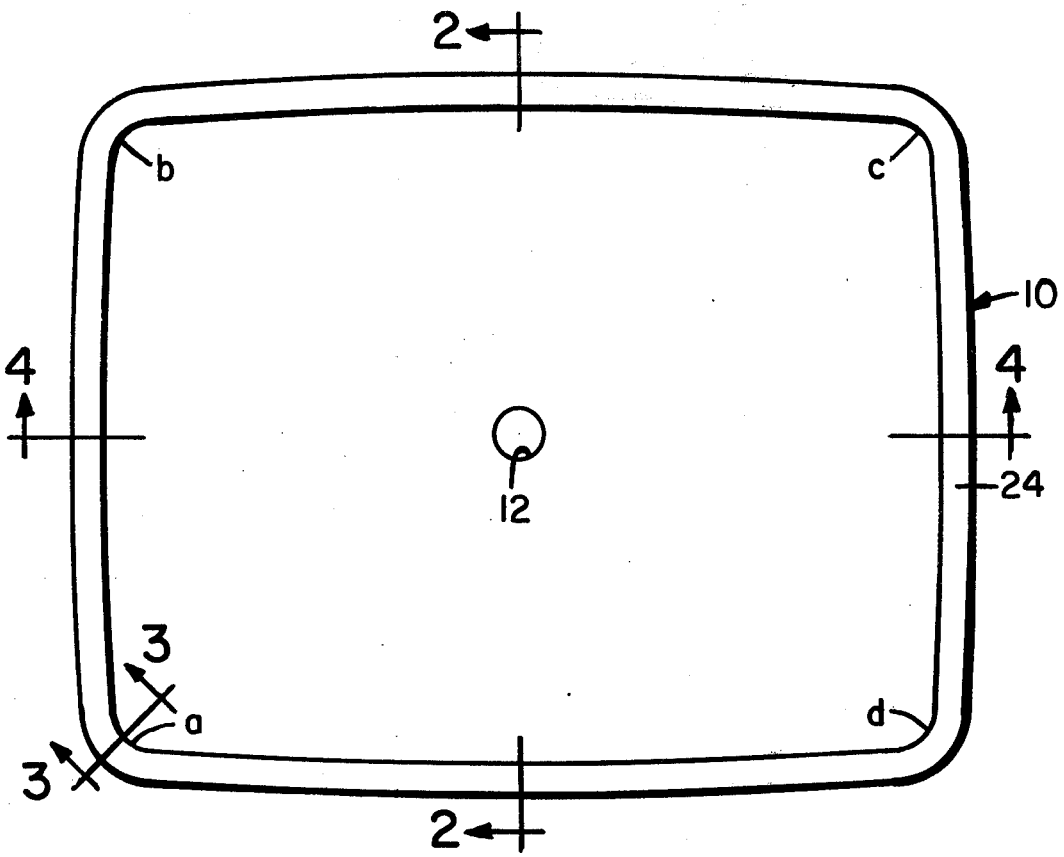
FIG. 1 is a plan view showing the open mouth portion of a funnel of the present invention.
Figure 2:
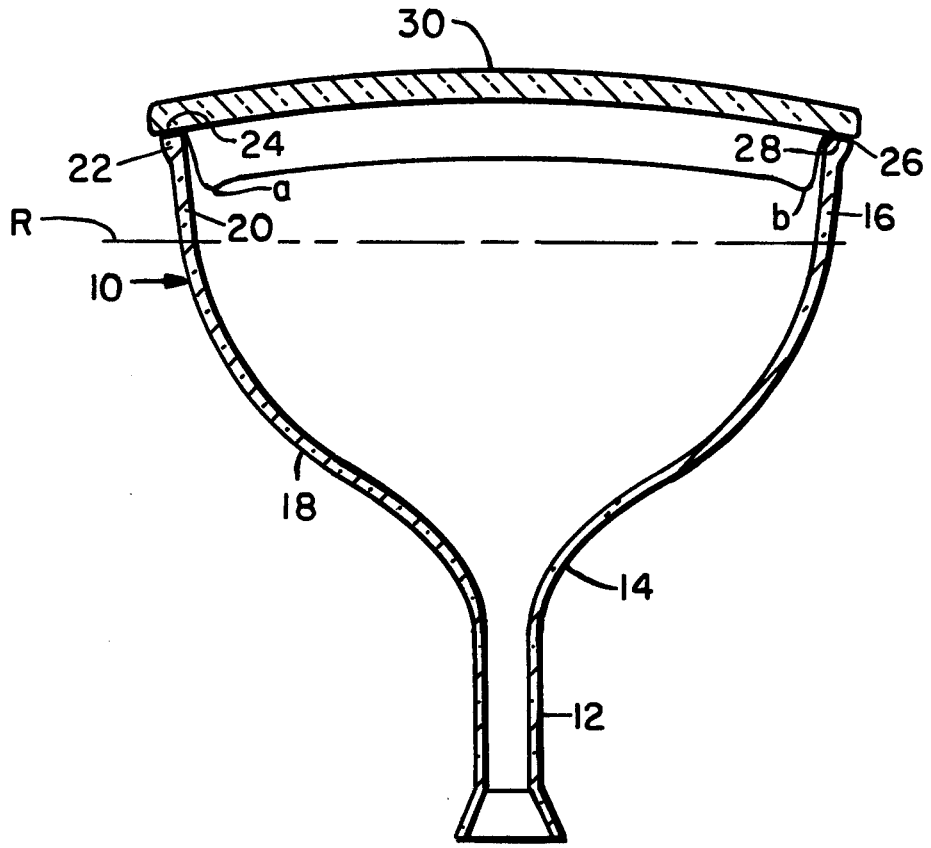
FIG. 2 is an elevational view in section taken along line 2—2 of FIG. 1, illustrating the funel in sealed engagement with a panel.
Figure 4:
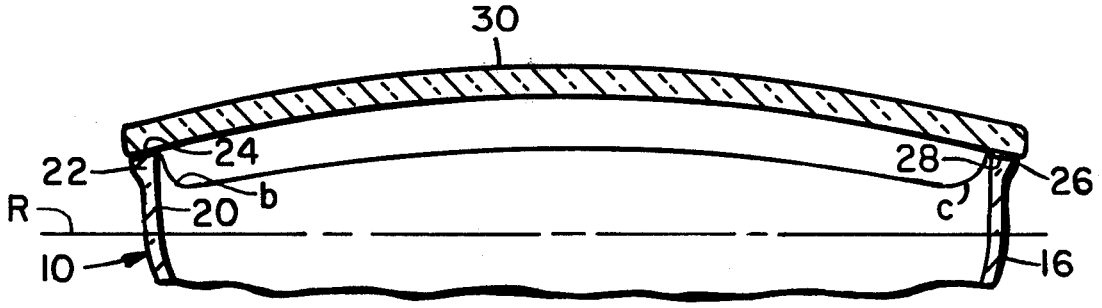
FIG. 4 is a fragmental elevational view in section taken along line 4—4 of FIG. 1, illustrating the funnel in sealed engagement with a panel.

Referring now to the drawings, a funnel 10 embodying my new configuration is shown having a neck portion 12, a yoke portion 14, and a wide mouth portion 16 of generally rectangular configuration as viewed in FIG. 1. As shown in FIG. 2, a reference plane R extends through the wide mouth portion 16 perpendicular to the axis of the funnel 10 extending through the circular opening of neck portion 12. The wall portions 18 below the reference plane R are generally curvilinear and are of uniform thickness down to the yoke portion 14. The wall portions 20 above the reference plane are uniformly tapered and increase in thickness as they extend outwardly away from said reference plane. The upper wall portions 20 have a flange portion 22 projecting outwardly about the upper outer surface of said wall portions, and such flanged upper wall portion terminates in a sealing edge portion 24 having substantial sealing area due to the width of the flange portion 22. As shown in FIGS. 2 and 4, the sealing edge portion 24 of the funnel 10 has a convex curvilinear configuration when viewed parallel to the funnel axis and is frit sealed at 26 with a mating sealing surface 28 of a panel member 30.

Whereas the lower uniform wall portions 18 below the reference plane R are generally curvilinear, the tapered upper wall portions 20 are not only generally linear, but also substantially parallel to the axis of the funnel 10. As shown in FIG. 2, the inner surface of the upper wall portions 20 is not perfectly parallel with the axis of the funnel but rather is provided with a slight draft angle necessary in production in order to remove the plunger. The linear upper wall portions provide added strength to the funnel which facilitate the utilization of thinner wall sections without loss of the required strength for forming a TV bulb. Whereas conventional bulbs necessitated heavy funnel walls extending downwardly from a relatively thick skirted panel in order to provide the requisite strength to compenste for the stresses concentrated about the seal area, the construction of the present design permits elastic deformation of the side walls of the funnel thereby reducing stress zones at the seal and uniformly distributing such stresses along the wall portions of the funnel. Not only do the thinner wall portions provide for stress distribution but also facilitate more rapid production rates in view of the fact that heat may be rapidly removed from the thinner wall portions thus reducing necessary cooling time. Further, less glass is utilized in the TV bulb produced with the present funnel construction from that of a conventional bulb thus not only saving raw materials and the energy necessary to melt such materials, but also providing a lighter bulb with the accompanying savings in shipping and handling.

Although the specific dimensions of a funnel produced in accordance with my invention will vary with the size and shape of the TV tube desired, the following specific example, which is by no means limiting in nature, is given merely as an illustrative example of a preferred embodiment of the invention. A funnel was press-formed from conventional TV funnel glass with curvilinear lower wall portions having a uniform thickness of about 0.2 inches extending from the yoke area to the reference plane. The reference plane was positioned about 5.1 inches from the yoke area. The upper side wall portions, above the reference plane, were of a linear construction, and with the exception of a 5° draft for withdrawing the plunger, were substantially parallel to the axis of the funnel. Further, the thickness of the upper wall portions tapered uniformly outwardly from the 0.2 inch thickness at the reference plane to a projected thickness (disregarding the flange portion) of about 0.3 inches at the sealing edge. The total sealing edge width, including the flange portion, was about 0.45 inches, and the heighth of the flange was about 0.22 inches with the thickness of the wall at the base of the flange varying between about 0.24 and 0.28 inches.

Figure 3:
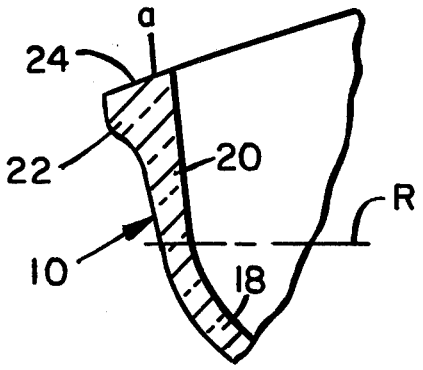
FIG. 3 is an enlarged fragmental elevational view in section taken along line 3—3 of FIG. 1.

The specific dimensions of the funnel will of course vary with different sizes and shapes of TV bulbs utilized. The reference plane R is located such that the minimum distance between the seal edge 24 and the plane R, which occurs at the lowest convex portions or diagonal corners *a*, *b*, *c* and *d* of the funnel seal edge, which are at a maximum distance from the funnel axis, as shown in FIGS. 1, 2 and 4, will be sufficient to accommodate the mounting hardware necessary to position a color selection electrode or mask, as it is commonly known, adjacent the viewing panel. Although additional strength is obtained by lowering the reference plane R and lengthening the straight upper wall portions 20, downward movement of the reference plane R is limited by the fact that the curvature of lower wall portions 18 must not be too severe in reaching the yoke area in accordance with good tube design. Accordingly, on a 19 inch bulb, the reference plane R may be within a range of about ¾ to 1½ inches below the sealing edge as measured at the diagonal corners, such as *a* shown in FIG. 3. The sealing edge may have a width of between about ⅜ and ⅝ inches whereas the heighth of the flange may vary around ¼ inch, but for strength purposes should not be less than about ⅛ inch.

Although I have disclosed the now preferred embodiments of my invention it will be apparent to those skilled in the art that various changes and modifications may be made thereto without departing from the spirit and scope thereof as defined in the appended claims.

I claim:

1. An improved funnel construction for use in a TV bulb which comprises, an open mouth portion having wall portions converging toward a yoke portion and a neck portion extending from said yoke portion, said funnel having an axis extending centrally through said neck portion, said wall portions terminating at said open mouth portion in a seal edge; said wall portions extending substantially linearly from an imaginary reference plane, which extends perpendicular to said funnel axis and through said wall portions, to said seal edge; a flange portion projecting outwardly of said linear wall portions adjacent said seal edge and forming a portion of said seal edge, and said linear wall portions uniformly increasing in thickness from said reference plane toward said seal edge.

2. An improved funnel construction for use in a TV bulb as defined in claim 1 wherein said funnel is of a rectangular configuration and said seal edge has a curvilinear configuration when viewed in a plane parallel to said funnel axis and has a substantially rectangular configuration when viewed in a plane perpendicular to said funnel axis.

3. An improved funnel construction for use in a TV bulb as defined in claim 1 wherein said linear wall portions extend substantially parallel to the axis of said funnel.

4. An improved funnel construction for use in a TV bulb as defined in claim 1 wherein said reference plane is located at a predetermined distance as measured along a line parallel to the axis of said funnel from a seal edge portion which is located at a maximum distance from said axis.

5. An improved funnel construction for use in a TV funnel which comprises, an open wide mouth portion having wall portions converging toward a yoke portion and a neck portion extending from said yoke portion, said funnel having an axis extending centrally through said neck portion, said wall portions terminating at said open mouth portion in a seal edge, said wall portions extending substantially linearly for a predetermined distance from said seal edge toward said yoke portion, a flange portion projecting outwardly of said linear wall portions adjacent said seal edge and forming a portion of said seal edge, said wall portions being of substantially uniform thickness from the end of said predetermined distance to said yoke area, and said linear wall portions uniformly increasing in thickness along said predetermined distance toward said seal edge.

6. An improved funnel construction for use in a TV bulb as defined in claim 5 wherein said uniform thickness wall portions have a curvilinear configuration.

7. An improved relatively thin-walled funnel construction for forming a TV bulb which comprises; a funnel member having a yoke portion terminating at one end in a circular opening and having wall portions flaring outwardly from the opposite end terminating in a seal edge of said funnel member; a longitudinal axis of said funnel extending centrally through said circular opening; said seal edge having a generally rectangular configuration when viewed in a plane perpendicular to said funnel axis, and having a generally convex configuration when viewed in a plane parallel to said funnel axis; the wall portions of said funnel between a reference plane, which extends perpendicular to said funnel axis and through wall portions of said funnel member at a minimum predetermined distance from a seal edge portion of said funnel located at the lower extent of said convex configuration, and said seal edge being substantially linear; the inner surface of such linear wall portions, with the exception of a manufacturing draft, being substantially parallel to the axis of said funnel; a flange portion projecting outwardly of, and extending about, the outer periphery of said linear wall portions adjacent said seal edge and forming a portion of said seal edge, the wall portions of said funnel member extending between the reference plane and said yoke portion being of substantially uniform thickness; and said linear wall portions uniformly increasing in thickness from the reference plane toward said seal edge.

8. An improved thin-walled funnel construction as defined in claim 7 wherein said uniform thickness wall portions are curvilinear, and a neck portion extends from the circular opening of said one end of said yoke portion.

* * * * *